US007516699B2

(12) United States Patent
Edwards et al.

(10) Patent No.: US 7,516,699 B2
(45) Date of Patent: Apr. 14, 2009

(54) METHOD FOR OPERATING A PRINTER WHICH REQUESTS PRINT DENSITY APPROVAL

(75) Inventors: Mark J. Edwards, Lexington, KY (US); John T. Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 447 days.

(21) Appl. No.: 11/208,117

(22) Filed: Aug. 19, 2005

(65) Prior Publication Data

US 2007/0039504 A1 Feb. 22, 2007

(51) Int. Cl.
*B41F 33/00* (2006.01)

(52) U.S. Cl. ..... 101/484; 347/15; 347/43

(58) Field of Classification Search ..... None
See application file for complete search history.

(56) References Cited

U.S. PATENT DOCUMENTS

| | | | |
|---|---|---|---|
| 5,615,312 | A | 3/1997 | Kohler |
| 5,633,662 | A | 5/1997 | Allen et al. |
| 5,663,750 | A | 9/1997 | Sakuma |
| 5,706,037 | A | 1/1998 | McIntyre |
| 5,812,156 | A | 9/1998 | Bullock et al. |
| 6,019,460 | A | 2/2000 | Ushiogi et al. |
| 6,196,663 | B1 | 3/2001 | Wetchler et al. |
| 6,233,410 | B1 | 5/2001 | Seber et al. |
| 6,527,366 | B1 | 3/2003 | Byers et al. |
| 6,594,028 | B1 | 7/2003 | Hamamoto et al. |
| 6,712,449 | B2 | 3/2004 | Smith |
| 6,764,155 | B2 | 7/2004 | D'Souza et al. |
| 6,803,989 | B2 | 10/2004 | Silverbrook |
| 6,863,374 | B2 | 3/2005 | Yamazaki et al. |
| 2005/0122368 | A1 | 6/2005 | Yamazaki et al. |
| 2006/0158673 | A1 * | 7/2006 | Gondek et al. ..... 358/1.13 |

FOREIGN PATENT DOCUMENTS

JP 2000326521 * 11/2000

* cited by examiner

*Primary Examiner*—Judy Nguyen
*Assistant Examiner*—Marissa L Ferguson-Samreth
(74) *Attorney, Agent, or Firm*—Thompson Hine LLP

(57) ABSTRACT

A method for operating a printer for printing a print job requiring at least one color ink. At least one printer operating parameter is chosen which may include a remaining ink volume of the at least one color ink. A first print density for one color ink is obtained for at least one future print job without regard to the obtained printer operating parameter(s). A different second print density for the one color ink is obtained for the at least one future print job based on at least the obtained printer operating parameter(s). A user prompt is issued for user approval or non-approval to use the second print density for the one color ink when printing the at least one future print job. The second print density is used upon receiving a user reply of approval. The first print density is used upon receiving a user reply of non-approval.

20 Claims, 1 Drawing Sheet

METHOD FOR OPERATING A PRINTER WHICH REQUESTS PRINT DENSITY APPROVAL

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to printers, and more particularly to a method for operating a printer which requests print density approval.

2. Description of the Related Art

Known printers include inkjet printers having color inks including a black color ink and three non-black-color inks (such as cyan, magenta and yellow inks). Such printers prompt a user to select a print mode for printing a print job. If a user selects a "best quality" mode, the printer takes a longer time to print the print job at a higher print density which consumes more ink. If a user selects a "draft quality" print mode, the printer takes a shorter time to print the print job at a lower print density which consumes less ink. When the ink supply for a color ink is low, the printer notifies the user that a replacement ink supply will soon be required.

SUMMARY OF THE INVENTION

A first method is for operating a printer for printing a print job requiring at least one color ink. The first method includes obtaining at least one printer operating parameter chosen from the group consisting of a remaining ink volume of the at least one color ink, at least one ink usage characteristic of at least one past print job, at least one ink usage characteristic of a next-to-be-printed print job, and a past ink usage frequency of the at least one color ink. The first method also includes determining a first print density for one of the at least one color ink for at least one future print job without regard to the obtained at least one printer operating parameter. The first method also includes determining a different second print density for the one color ink for the at least one future print job based on at least the obtained at least one printer operating parameter. The first method also includes issuing a user prompt for user approval or non-approval to use the second print density for the one color ink when printing the at least one future print job. The first method also includes using the second print density for the one color ink when printing the at least one future print job upon receiving a user reply of approval. The first method also includes using the first print density for the one color ink when printing the at least one future print job upon receiving a user reply of non-approval.

A second method is for operating a printer for printing a print job requiring at least one color ink. The second method includes obtaining at least two printer operating parameters chosen from the group consisting of a remaining ink volume of the at least one color ink, at least one ink usage characteristic of at least one past print job, at least one ink usage characteristic of a next-to-be-printed print job, and a past ink usage frequency of the at least one color ink, wherein the at least two printer operating parameters include the remaining ink volume of the at least one color ink. The second method also includes determining a first print density for one of the at least one color ink for at least one future print job without regard to the obtained at least two printer operating parameters. The second method also includes determining a lower second print density for the one color ink for the at least one future print job based on at least the obtained at least two printer operating parameters. The second method also includes issuing a user prompt for user approval or non-approval to use the second print density for the one color ink when printing the at least one future print job. The second method also includes using the second print density for the one color ink when printing the at least one future print job upon receiving a user reply of approval. The second method also includes using the first print density for the one color ink when printing the at least one future print job upon receiving a user reply of non-approval.

A third method is for operating an inkjet printer for printing a print job requiring at least two color inks including a black color ink and a non-black color ink. The third method includes obtaining at least two printer operating parameters chosen from the group consisting of a remaining ink volume of the at least two color inks, at least one ink usage characteristic of at least one past print job, at least one ink usage characteristic of a next-to-be-printed print job, and a past ink usage frequency of the at least two color inks, wherein the at least two printer operating parameters include the remaining ink volume of the at least two color inks. The third method also includes determining a first print density for one of the at least two color inks for at least one future print job without regard to the obtained at least two printer operating parameters. The third method also includes determining a lower second print density for the one color ink for the at least one future print job based on at least the obtained at least two printer operating parameters. The third method also includes issuing a user prompt for user approval or non-approval to use the second print density for the one color ink when printing the at least one future print job. The third method also includes using the second print density for the one color ink when printing the at least one future print job upon receiving a user reply of approval. The third method also includes using the first print density for the one color ink when printing the at least one future print job upon receiving a user reply of non-approval.

In one example of each of the first, second and third methods, the user is given the opportunity to adjust the print density of subsequent print jobs in order to best optimize a user-approved balance between print quality and ink cartridge yield.

DETAILED DESCRIPTION

Figure 1:
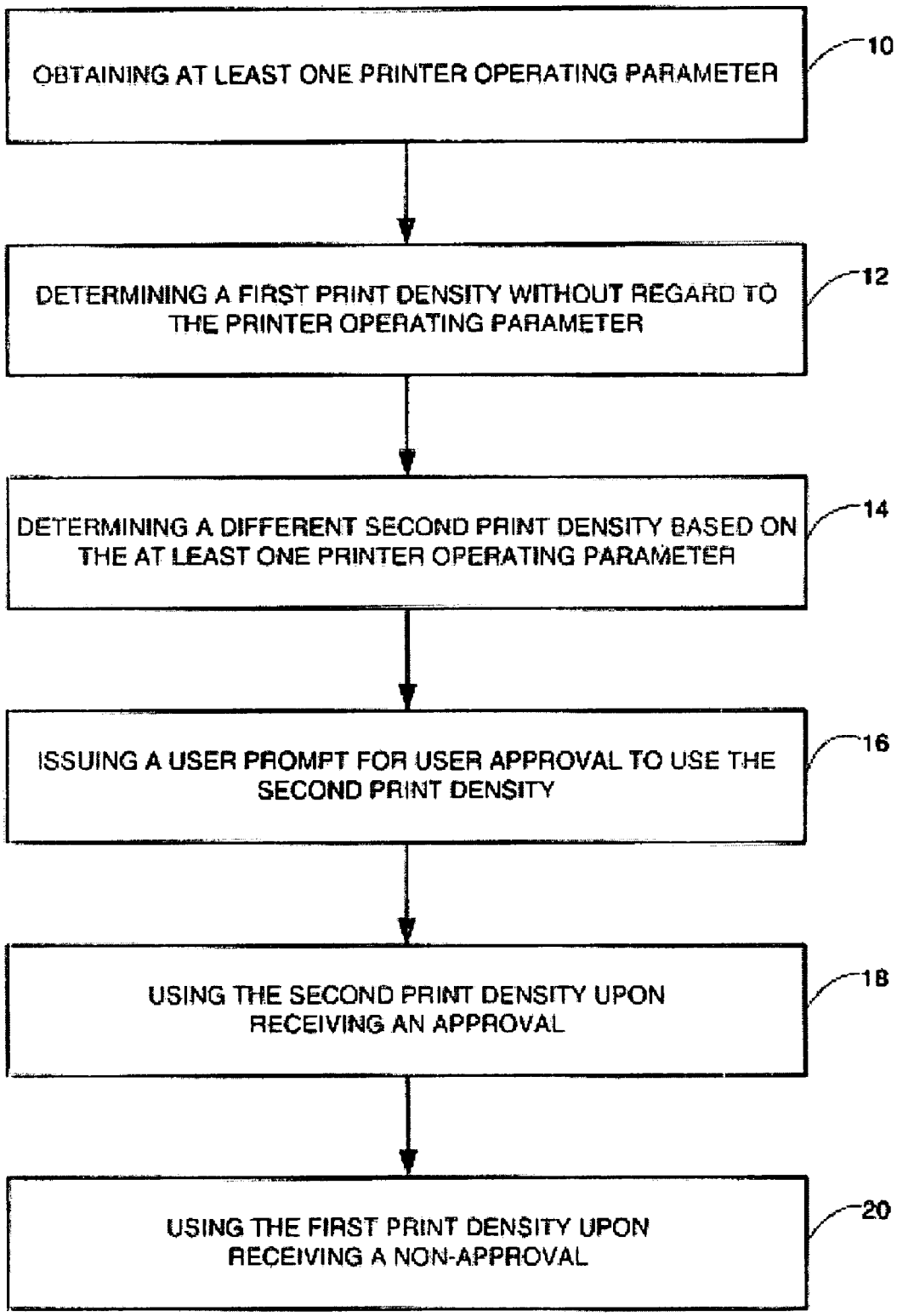
FIG. 1 is a block diagram of a first method of the invention.

Referring to FIG. 1, a first method of the invention is for operating a printer for printing a print job requiring at least one color ink. The first method includes, as indicated generally by block 10 of FIG. 1, obtaining at least one printer operating parameter chosen from the group consisting of a remaining ink volume of the at least one color ink, at least one ink usage characteristic of at least one past print job, at least one ink usage characteristic of a next-to-be-printed print job, and a past ink usage frequency of the at least one color ink. The first method also includes, as indicated generally by block 12 of FIG. 1, determining a first print density for one (i.e., at least one) of the at least one color ink for at least one future print job without regard to the obtained at least one printer operating parameter. The first method also includes, as indicated generally by block 14 of FIG. 1, determining a different second print density (i.e., different from the first print density) for the one color ink (i.e., the one of the at least one ink color) for the at least one future print job based on at least the obtained at least one printer operating parameter. The first method also includes, as indicated generally by block 16 of FIG. 1, issuing a user prompt for user approval or non-approval to use the second print density for the one color ink when printing the at least one future print job. The first method also includes, as indicated generally by block 18 of FIG. 1, using the second print density for the one color ink when printing the at least one future print job upon receiving a user reply of approval. The first method also includes, as indicated generally by block 20 of FIG. 1 using the first print density for the one color ink when printing the at least one future print job upon receiving a user reply of non-approval.

"Print density" in general refers to the amount of ink placed on a printed page. Techniques for determining a first print density for a print job (which inherently includes determining a first print density for one of the at least one color ink) without regard to the obtained at least one printer operating parameter are well known to those skilled in the art. One example of color ink is black ink. Another example of color ink is non-black ink such as, without limitation, cyan ink, magenta ink or yellow ink. One example of a printer which uses color ink is an inkjet printer.

In one extension of the first method, the determining of the different second print density, the issuing of the user prompt, and the using the second print density for the one color ink when printing are performed only when the at least one printer operating parameter meets a predetermined condition (s). In one implementation of the first method, the predetermined condition(s) give different weights to different obtained printer operating parameters. In one enablement, greater weight is given to the remaining ink volume of the at least one color ink (when present as a printer operating parameter) than to any other printer operating parameter.

Obtaining a remaining ink volume of the at least one color ink includes, without limitation, obtaining an indication of an adequate or a low ink volume of each of the at least one color ink and includes obtaining a more exact indication of ink volume of each of the at least one color ink. Techniques for obtaining such ink volume indication are well known to those skilled in the art. Determining a different second print density for the one color ink for at least one future print job based on the remaining ink volume of the one color ink includes, without limitation, choosing a lower second print density than the first print density to increase ink yield when an indication of low volume for the one color ink has been obtained.

Obtaining at least one ink usage characteristic of at least one past print job includes, without limitation, obtaining an indication of how much ink volume was used (such as by counting ink drops) for each of the at least one color ink for at least one past print job. Determining a different second print density for the one color ink for at least one future print job based on at least one ink usage characteristic of at least one past print job includes, without limitation, choosing a lower second print density than the first print density to increase ink yield when an indication of greater past use of the one color ink, relative to the other color inks or to a threshold, has been obtained.

Obtaining at least one ink usage characteristic of a next-to-be-printed print job includes, without limitation, obtaining an indication of how much ink volume will be used (such as by calculating the number of ink drops that will be required) for the next-to-be-printed print job. Determining a different second print density for the one color ink for the next-to-be-printed print job based on at least one ink usage characteristic of the next-to-be-printed print job includes, without limitation, choosing a lower second print density than the first print density to increase ink yield when an indication of greater use of the one color ink, relative to the other color inks or to a threshold or to a remaining ink volume, has been obtained.

Obtaining a past ink usage frequency of the at least one color ink includes, without limitation, obtaining an indication of how often the at least one color ink was used in the past. Determining a different second print density for the one color ink for at least one future print job based on the past ink usage frequency for the one color ink includes, without limitation, choosing a higher second print density than the first print density to increase print quality when an indication of low past ink usage for the one color ink has been obtained indicating the one color ink will dry out and become non-usable due to infrequent use.

In one employment of the first method, the at least one printer operating parameter includes the remaining ink volume of the at least one color ink. In one application of the first method, the second print density is less than the first print density. In one variation, the determining of the different second print density includes printing samples of different print densities and issuing a user prompt to select one of the printing samples to be the second print density. In a different application, the at least one printer operating parameter includes the past ink usage frequency of the at least one color ink, and the second print density is greater than then first print density. In one illustration of the first method, the at least one future print job is the next-to-be-printed print job.

In one deployment of the first method, the at least one future print job uses at least two color inks, and the at least one printer operating parameter includes the remaining ink volume of the at least two color inks. In one variation of this deployment, the user prompt also includes a request for approval or non-approval to use the second print density for every color ink of the at least one future print job. In one modification of this deployment, the at least two color inks include a black ink and a non-black ink. In one example of this modification, the one color ink is the black ink, and the user prompt also includes a request for approval or non-approval to use the second print density only for the black ink for all future print jobs. In the same or a different example of this modification, the one color ink is the black ink, and the user prompt also includes a request for approval or non-approval to use the second print density only for the black ink for all black-ink-only future print jobs. In a different example of this modification, the one color ink is the non-black ink, and the user prompt also includes a request for approval or non-approval to use the second print density for every color ink for all non-black-ink-only future print jobs. Other examples and modifications are left to the artisan.

A second method is for operating a printer for printing a print job requiring at least one color ink. The second method includes obtaining at least two printer operating parameters chosen from the group consisting of a remaining ink volume of the at least one color ink, at least one ink usage characteristic of at least one past print job, at least one ink usage characteristic of a next-to-be-printed print job, and a past ink usage frequency of the at least one color ink, wherein the at least two printer operating parameters include the remaining ink volume of the at least one color ink. The second method also includes determining a first print density for one (i.e., at least one) of the at least one color ink for at least one future print job without regard to the obtained at least two printer operating parameters. The second method also includes determining a lower second print density (i.e., lower than the first print density) for the one color ink (i.e., the one of the at least one color ink) for the at least one future print job based on at least the obtained at least two printer operating parameters. The second method also includes issuing a user prompt for user approval or non-approval to use the second print density for the one color ink when printing the at least one future print job. The second method also includes using the second print density for the one color ink when printing the at least one future print job upon receiving a user reply of approval. The second method also includes using the first print density for the one color ink when printing the at least one future print job upon receiving a user reply of non-approval.

A third method is for operating an inkjet printer for printing a print job requiring at least two color inks including a black color ink and a non-black color ink. The third method includes obtaining at least two printer operating parameters chosen from the group consisting of a remaining ink volume of the at least two color inks, at least one ink usage characteristic of at least one past print job, at least one ink usage characteristic of a next-to-be-printed print job, and a past ink usage frequency of the at least two color inks, wherein the at least two printer operating parameters include the remaining ink volume of the at least two color inks. The third method also includes determining a first print density for one (i.e., at least one) of the at least two color inks for at least one future print job without regard to the obtained at least two printer operating parameters. The third method also includes determining a lower second print density (i.e., lower than the first print density) for the one color ink (i.e., the one of the at least one color ink) for the at least one future print job based on at least the obtained at least two printer operating parameters. The third method also includes issuing a user prompt for user approval or non-approval to use the second print density for the one color ink when printing the at least one future print job. The third method also includes using the second print density for the one color ink when printing the at least one future print job upon receiving a user reply of approval. The third method also includes using the first print density for the one color ink when printing the at least one future print job upon receiving a user reply of non-approval.

In one implementation of the second and/or the third method, the determining of the different second print density includes printing samples of different print densities and issuing a user prompt to select one of the printing samples to be the second print density. In the same or a different implementation, the at least one future print job is the next-to-be-printed print job. In the same or a different implementation, the user prompt also includes a request for approval or non-approval to use the second print density for every color ink of the at least one future print job. In one enablement of the first, second and/or third method, all four of the previously listed printer operating parameters of the previously mentioned group are obtained.

The following paragraphs describe specific illustrations applicable to one or more or all of the first, second and third methods, wherein reservoirs each contain a volume of a different color ink. In one variation, there is one reservoir of one color ink per replaceable ink cartridge. In a different variation, there are two or more reservoirs, each of a different color ink, per replaceable ink cartridge. The ink cartridge may or may not include a printhead.

In one illustration, when the first one of the cartridges reaches an "ink low" state, a user receives a low ink warning. The user is also prompted to determine if print density should be changed. Specifically, the user is given the opportunity to print documents with less density to extend the life of the current cartridge. This would be useful, for instance, if the user is not able to obtain a new cartridge in the near future. In one variation, when "low ink" is met for the black-ink cartridge only, a prompt is displayed giving the user a list of options, for example: continuing without a print density change; reducing the print density of just the black cartridge, for all future print jobs; reducing the print density of just the black cartridge for all future black-only print jobs (print jobs requiring both the black and non-black cartridges would still use full density black); and reducing the print density of all of the cartridges. In another variation, when "low ink" is met for a non-black cartridge only, a prompt is displayed giving the user a list of options, for example: continuing without a print density change; reducing the print density of all cartridges, for all future print jobs including non-black (black print jobs would still use full density black); and reducing the print density of all of the cartridges, for all future print jobs. In a further variation, when "low ink" has been reached for both a non-black and a black cartridge, a prompt is displayed giving the user a new list of options, for example: continuing without a print density change; and reducing the print density of all of the cartridges for all future print jobs.

Additional options are of course possible for each situation above; those shown above are illustrative. For instance, useful additional options might be to stop future polling ("Do not ask me this again" checkbox), and to print a sample page showing examples of the different print density options. If the user chooses to print a sample, several instances of a predefined sample consisting of text and/or graphics are printed, one at the typical print density, and one or more using each reduced print density option, each instance being clearly labeled with the option number, to let the user more easily select among options.

A variation on the above embodiment is to also incorporate the characteristics of a current print job to determine if the user is even polled. If ink is low, and the document will use a relatively large amount of ink, perhaps only then is the user given the option of reducing print density for the upcoming job. This will result in slightly lighter but still uniform print density over the entire upcoming print job, rather than a variable print density as the cartridge runs out of ink. Subsequent print jobs could either return to full density or use the new lighter density. If the amount of ink needed for a print job is substantially large, the user could even be notified that the job can not be printed in its entirety at acceptable quality.

The lower ink density, and consequently lower cost per page, offered near the end of cartridge life might be attractive to the user throughout the entire cartridge life. Thus, in one embodiment, the options for lower density might be presented to the user at first cartridge install. Such polling could also occur at one or more points throughout cartridge life. The additional options described above, i.e., stop polling option, etc., can be included in this embodiment.

If it is detected that a user consistently or typically prints in a high quality mode, the user may not be aware of the different mode settings ("stuck" on high quality mode) or that high quality modes typically use more ink. Detection of such a scenario could either be based on percentage of total print jobs using a high quality mode or the consecutive number of print jobs in a high quality mode. Once detected, the user can be polled with the opportunity to reduce printing cost by reducing ink density. An alternative here is to change the print mode itself, which can offer lower ink usage and increase printing speed.

Because ink cartridges can dry out before being fully utilized, a user that prints infrequently at a low quality mode may be able to increase print quality (use more ink) without affecting cost per page. Simply put, if the cartridge is going to dry out anyway, the user may as well use more ink to increase print quality. Thus, if it is detected that the user typically prints in a low quality mode at an infrequent total rate, the user can be polled to determine if higher quality output (at a better print quality mode), although slower, might be more suitable. The user poll can be worded along the lines of "Based on your typical usage pattern, your print quality can be improved without significantly affecting printing cost. Would you like to improve your print quality?"

If a user has chosen to reduce density in the past but later requires full density for a print job, capability optionally can be provided for the user to return to full density. For example, the print driver can have the density selection available for adjustment, so that when the user sets the print mode and other options, the user can also easily select to return to full density. Alternatively, any print density adjustments could be effective for only certain print modes. For example, print density could be reduced for all modes except for "best" mode. Such an implementation would be clearly communicated to the user so that he/she could simply choose "best" mode when full density is needed.

In one example of each of the first, second and third methods, the user is given the opportunity to adjust the print density of subsequent print jobs in order to best optimize a user-approved balance between print quality and ink cartridge yield.

The foregoing description of several methods of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for operating a printer for printing a print job requiring at least one color ink comprising:

obtaining at least one printer operating parameter chosen from the group consisting of a remaining ink volume of the at least one color ink, at least one ink usage characteristic of at least one past print job, at least one ink usage characteristic of a next-to-be-printed print job, and a past ink usage frequency of the at least one color ink;

determining a first print density for one of the at least one color ink for at least one future print job without regard to the obtained at least one printer operating parameter;

determining a different second print density for the one color ink for the at least one future print job based on at least the obtained at least one printer operating parameter;

issuing a user prompt for user approval or non-approval to use the second print density for the one color ink when printing the at least one future print job;

using the second print density for the one color ink when printing the at least one future print job upon receiving a user reply of approval; and using the first print density for the one color ink when printing the at least one future print job upon receiving a user reply of non-approval, wherein the at least one future print job uses at least two color inks including a black ink and a non-black ink, wherein the one color ink is the black ink, and wherein the user prompt also includes a request for approval or non-approval to use the second print density only for the black ink for all future print jobs.

2. The method of claim 1, wherein the at least one printer operating parameter includes the remaining ink volume of the at least one color ink.

3. The method of claim 1, wherein the second print density is less than the first print density.

4. The method of claim 3, wherein the determining of the different second print density includes printing samples of different print densities and issuing a user prompt for selection of one of the printing samples to be the second print density.

5. The method of claim 1, wherein the at least one printer operating parameter includes the past ink usage frequency of the at least one color ink, and wherein the second print density is greater than the first print density.

6. The method of claim 1, wherein the at least one future print job is the next-to-be-printed print job.

7. The method of claim 1, wherein the at least one printer operating parameter includes the remaining ink volume of the at least two color inks.

8. The method of claim 1, wherein the user prompt also includes a request for approval or non-approval to use the second print density for every color ink of the at least one future print job.

9. The method of claim 1, wherein the user prompt also includes a request for approval or non-approval to use the second print density only for the black ink for all black-ink-only future print jobs.

10. A method for operating a printer for printing a print job requiring at least one color ink comprising:

obtaining at least one printer operating parameter chosen from the group consisting of a remaining ink volume of the at least one color ink, at least one ink usage characteristic of at least one past print job, at least one ink usage characteristic of a next-to-be-printed print job, and a past ink usage frequency of the at least one color ink;

determining a first print density for one of the at least one color ink for at least one future print job without regard to the obtained at least one printer operating parameter;

determining a different second print density for the one color ink for the at least one future print job based on at least the obtained at least one printer operating parameter;

issuing a user prompt for user approval or non-approval to use the second print density for the one color ink when printing the at least one future print job;

using the second print density for the one color ink when printing the at least one future print job upon receiving a user reply of approval; and using the first print density for the one color ink when printing the at least one future print job upon receiving a user reply of non-approval, wherein the at least one future print job uses at least two color inks including a black ink and a non-black ink, wherein the one color ink is the non-black ink, and wherein the user prompt also includes a request for approval or non-approval to use the second print density for every color ink for all non-black-ink-only future print jobs.

11. A method for operating a printer for printing a print job requiring at least one color ink comprising:

obtaining at least two printer operating parameters chosen from the group consisting of a remaining ink volume of the at least one color ink, at least one ink usage characteristic of at least one past print job, at least one ink usage characteristic of a next-to-be-printed print job, and a past ink usage frequency of the at least one color ink, wherein the at least two printer operating parameters include the remaining ink volume of the at least one color ink;

determining a first print density for one of the at least one color ink for at least one future print job without regard to the obtained at least two printer operating parameters;

determining a lower second print density for the one color ink for the at least one future print job based on at least the obtained at least two printer operating parameters;

issuing a user prompt for user approval or non-approval to use the second print density for the one color ink when printing the at least one future print job;

using the second print density for the one color ink when printing the at least one future print job upon receiving a user reply of approval; and using the first print density for the one color ink when printing the at least one future print job upon receiving a user reply of non-approval, wherein the at least one future print job uses at least two color inks including a black ink and a non-black ink, wherein the at least one color ink is the black ink, and wherein the user prompt also includes a request for approval or non-approval to use the second print density only for the black ink for all black-ink-only future print jobs.

12. The method of claim 11, wherein the determining of the different second print density includes printing samples of different print densities and issuing a user prompt to select one of the printing samples to be the second print density.

13. The method of claim 11, wherein the at least one future print job is the next-to-be-printed print job.

14. The method of claim 11, wherein the user prompt also includes a request for approval or non-approval to use the second print density for every color ink of the at least one future print job.

15. The method of claim 11, wherein the user prompt also includes a request for approval or non-approval to use the second print density only for the black ink for all future print jobs.

16. A method for operating an inkjet printer for printing a print job requiring at least two color inks including a black color ink and a non-black color ink, comprising:

obtaining at least two printer operating parameters chosen from the group consisting of a remaining ink volume of the at least two color inks, at least one ink usage characteristic of at least one past print job, at least one ink usage characteristic of a next-to-be-printed print job, and a past ink usage frequency of the at least two color inks, wherein the at least two printer operating parameters include the remaining ink volume of the at least two color inks;

determining a first print density for one of the at least two color inks for at least one future print job without regard to the obtained at least two printer operating parameters;

determining a lower second print density for the one color ink for the at least one future print job based on at least the obtained at least two printer operating parameters;

issuing a user prompt for user approval or non-approval to use the second print density for the one color ink when printing the at least one future print job;

using the second print density for the one color ink when printing the at least one future print job upon receiving a user reply of approval; and using the first print density for the one color ink when printing the at least one future print job upon receiving a user reply of non-approval, wherein the at least one future print job uses at least two color inks including a black ink and a non-black ink, wherein one of the at least two color ink is the non-black ink, and wherein the user prompt also includes a request for approval or non-approval to use the second print density for every color ink for all non-black-ink-only future print jobs.

17. The method of claim 16, wherein the determining of the different second print density includes printing samples of different print densities and issuing a user prompt to select one of the printing samples to be the second print density.

18. The method of claim 16, wherein the at least one future print job is the next-to-be-printed print job.

19. The method of claim 16, wherein the user prompt also includes a request for approval or non-approval to use the second print density for every color ink of the at least one future print job.

20. A method for operating a printer for printing a print job requiring at least one color ink comprising:

obtaining at least one printer operating parameter chosen from the group consisting of a remaining ink volume of the at least one color ink, at least one ink usage characteristic of at least one past print job, at least one ink usage characteristic of a next-to-be-printed print job, and a past ink usage frequency of the at least one color ink;

determining a first print density for one of the at least one color ink for at least one future print job without regard to the obtained at least one printer operating parameter;

determining a different second print density for the one color ink for the at least one future print job based on at least the obtained at least one printer operating parameter;

issuing a user prompt for user approval or non-approval to use the second print density for the one color ink when printing the at least one future print job;

using the second print density for the one color ink when printing the at least one future print job upon receiving a user reply of approval; and using the first print density for the one color ink when printing the at least one future print job upon receiving a user reply of non-approval, wherein the determining of the different second print density includes printing samples of different print densities and issuing a user prompt for selection of one of the printing samples to be the second print density.

* * * * *